US010071877B2

(12) United States Patent
Herrmann et al.

(10) Patent No.: US 10,071,877 B2
(45) Date of Patent: Sep. 11, 2018

(54) DYNAMIC DUAL BIN POSITION COLLATION SYSTEM

(71) Applicant: XEROX CORPORATION, Norwalk, CT (US)

(72) Inventors: Douglas K Herrmann, Webster, NY (US); Kevin St Martin, Rochester, NY (US); Timothy J Kelley, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/955,012

(22) Filed: Apr. 17, 2018

(65) Prior Publication Data

US 2018/0229959 A1 Aug. 16, 2018

Related U.S. Application Data

(63) Continuation-in-part of application No. 15/367,214, filed on Dec. 2, 2016.

(51) Int. Cl.

| | |
|---|---|
| ***B65H 31/30*** | (2006.01) |
| ***B65H 29/60*** | (2006.01) |
| ***B65H 31/24*** | (2006.01) |
| ***B65H 39/043*** | (2006.01) |

(52) U.S. Cl.

CPC ..... *B65H 39/043* (2013.01); *B65H 29/60* (2013.01); *B65H 31/24* (2013.01); *B65H 31/3081* (2013.01); *B65H 2301/4212* (2013.01); *B65H 2301/42266* (2013.01); *B65H 2301/4352* (2013.01); *B65H 2701/1914* (2013.01)

(58) Field of Classification Search

CPC .. B65H 39/043; B65H 31/24; B65H 31/3081; B65H 2301/4212; B65H 2301/42266; B65H 2301/4352; B65H 2701/1914

See application file for complete search history.

(56) References Cited

U.S. PATENT DOCUMENTS

| | | | | |
|---|---|---|---|---|
| 8,342,505 | B2 * | 1/2013 | DeFigueiredo | B65H 29/12 271/9.13 |
| 9,463,945 | B2 * | 10/2016 | Herrmann | B65H 37/00 |
| 9,463,946 | B2 * | 10/2016 | Herrmann | B65H 31/02 |
| 9,527,693 | B2 * | 12/2016 | Herrmann | B65H 31/02 |
| 9,592,989 | B2 * | 3/2017 | Herrmann | B65H 39/115 |
| 9,624,062 | B1 * | 4/2017 | Herrmann | B65H 31/20 |

* cited by examiner

*Primary Examiner* — Patrick Cicchino

(57) ABSTRACT

A system that eliminates return and reset of a pusher in a media collation system includes the use of bidirectional bins that allow accumulated sets of media in the bins to be collated in first or second directions and pushed to either of two banders rather than being restricted to one bander.

20 Claims, 5 Drawing Sheets

DYNAMIC DUAL BIN POSITION COLLATION SYSTEM

This disclosure is a continuation-in-part of copending U.S. application Ser. No. 15/367,214, entitled DYNAMIC DUAL BIN POSTION COLLATIN SYSTEM, filed Dec. 2, 2016 by the same inventors, and claims priority therefrom.

Cross reference is hereby made to copending and commonly assigned U.S. patent application Ser. No. 15/358,317 to Douglas K. Herrmann filed Nov. 22, 2016 and entitled SEQUENTIAL DIE CUT AND SLITTING FOR IMPROVED COLLATION.

BACKGROUND

1. Field of the Disclosure

The presently disclosed embodiments are directed to providing an auto-collation system, and more particularly, to a collation system having dual positioning bins, and even more particularly to a collation system having a two-way pusher that quickly and accurately removes media from the bins and into single or dual banders.

2. Description of Related Art

Retail stores often utilize signage to convey information regarding products offered for sale, for example, product cost, unit cost, sale pricing, etc. Such signage must be updated and/or replaced on a periodic basis. For example, regular product pricing may change, or during a sale, a discounted price may be necessary. Changes to signage may be required for hundreds or even thousands of products and these changes may be required daily, weekly or another periodic term. In some states, it is critical that the signage be updated in a timely fashion as the retail store may be obligated to honor the price displayed adjacent the product. In other words, if the store fails to remove signage that displays a discounted cost, the store must charge that cost if a customer relies upon that price when making a purchase selection. In view of the foregoing, it should be apparent that proper timing and placement of signage is a critical responsibility of a retail store.

Although some retail chain stores share common store layouts, also known as a store planogram, most retail locations, even within a chain store, have unique store planograms. The changeover of signage can incur significant time which in turn incurs significant cost. A common practice is to print sheets of signage and an employee or group of employees are tasked with signage changeover. These methods include various deficiencies, for example, sheets printed out of order or not matched to the store planogram, sheets that require further separation of individual signage labels, etc.

In view of the foregoing issues, some stores require signage to be in a per store planogram order and to be pre-separated, both to facilitate the efficient changeover of signage. It has been found that to achieve this arrangement of signage, signage labels or cards are imposed so that each set of labels is in sequential order within a sheet and then across the collection of sheets. For example, cards may be delivered to various stores in stacks of ninety-six cards each stack thereby requiring three sheets, each sheet containing thirty-two labels, to be collated sequentially to produce a complete stack. Cards of this type may be cut using a high speed cutting system. The cards may be fed from a slitter system into bins, however it has been found that these systems are ineffective as the cards are not guided and adjacent cards interfere with each other as they bounce and settle into the bins. Such systems cause a high percentage of media jams and thus result is downtime and increased costs.

The heretofore mentioned problems were addressed in U.S. Pat. No. 9,463,946 which is incorporated herein by reference to the extent needed to practice the present disclosure and provides a system for collating a plurality of media including a first bin, a second bin arranged adjacent to the first bin, a collated stack receiver arranged proximate the second bin opposite the first bin, first, second and third guides, where the first and second guides are positioned on opposing sides of the first bin, and the second and third guides are positioned on opposing sides of the second bin, and a pusher. When the first, second and third guides are positioned in non-retracted locations, a first set of the plurality of media is deposited in the first bin and a second set of the plurality of media is deposited in the second bin, and when the first, second and third guides are positioned in retracted locations, the pusher moves the first set to the second bin vertically above the second set to form a first combined set and then moves the first combined set to a collated stack receiver.

This system employs a set of static angled collation bins and a one-direction pusher that directs media into a single bander. After each push the collation system resets by dynamically dropping the pusher and rewinding the pusher under the bins and then actuating the pusher into an up position to home to prepare for the next collation. Because the system must reset to the home position after each push, significant time is added to the overall process and system timing is negatively affected. However, this drop and reset to height causes additional vibration and settling issues and requires accounting for settling time.

The present disclosure addresses all of these problems in a practical and cost effective system and method.

BRIEF SUMMARY

Accordingly, a dynamic dual bin position collation system is disclosed that eliminates return and reset of the heretofore-mentioned pusher system by providing a dynamic bin system that allows accumulated sets of media to be collated in forward and back directions and pushed to two banders rather than being restricted to one bander and thereby increasing the productivity of the collation system.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Moreover, although any methods, devices or materials similar or equivalent to those described herein can be used in the practice or testing of these embodiments, some embodiments of methods, devices, and materials are now described.

Figure 1:
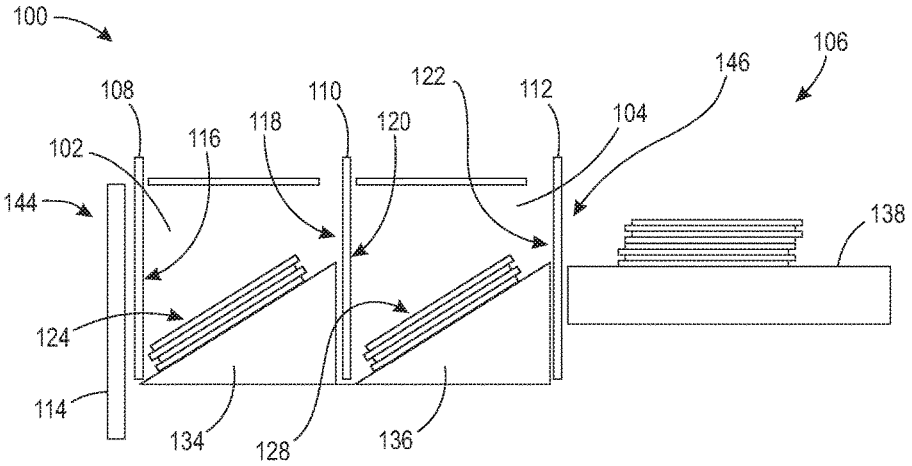
FIG. 1 PRIOR ART
FIG. 1 is a side elevational view of a prior art system for collating media with a plurality of guides in non-retracted positions.

Prior art FIG. 1 of U.S. Pat. No. 9,463,946 shows system for collating a plurality of media, i.e., system 100, includes first bin 102, second bin 104 arranged adjacent to first bin 102, collated stack receiver 106 arranged proximate second bin 104 opposite first bin 102, first, second and third guides 108, 110 and 112, respectively, and pusher 114. First guide 108 and second guide 110 are positioned on opposing sides of first bin 102, i.e., sides 116 and 118, while second guide 110 and third guide 112 are positioned on opposing sides of second bin 104, i.e., sides 120 and 122. When first, second and third guides 108, 110 and 112, respectively, are positioned in non-retracted locations, first set 124 of plurality of media 126 is deposited in first bin 102 and second set 128 of plurality of media 126 is deposited in second bin 104. When the first, second and third guides 108, 110 and 112, respectively, are positioned in retracted locations as shown in FIG. 2, pusher 114, in the direction depicted by unidirectional arrows 130, moves first set 124 to second bin 104 vertically above second set 128 to form a first combined set, i.e., combined set 132, and moves combined set 132 to collated stack receiver 106.

Figure 2:
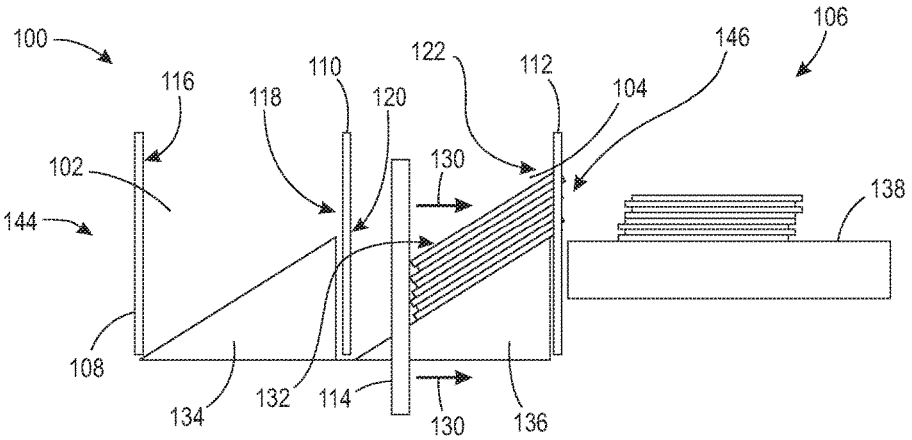
FIG. 2 PRIOR ART
FIG. 2 is a side elevational view of the prior art system depicted in FIG. 1 with the plurality of guides in retracted positions and a pusher moving stacks of media toward a collated stack receiver.

In FIGS. 1 and 2, first bin 102 comprises angularly disposed shelf 134 and second bin 104 comprises angularly disposed shelf 136. When first, second and third guides 108, 110 and 112, respectively, are positioned in non-retracted locations, first set 124 of plurality of media 126 is deposited on angularly disposed shelf 134 and second set 126 of plurality of media 126 is deposited on angularly disposed shelf 136. Moreover, when first, second and third guides 108, 110 and 112, respectively, are positioned in retracted locations as in FIG. 2, pusher 114 moves first set 124 to angularly disposed shelf 136 vertically above second set 128 to form combined set 132 and moves combined set 132 to collated stack receiver 106.

The auto-collation system 100 of FIG. 1 employs a set of static angled collation bins 101 and 102 and a one-direction pusher 114 to guide media from the bins to a single bander. After each push pusher 114 must go through a cumbersome process of dropping below the bins and rewinding to a home position in order to prepare for the next collation. Rewinding to the home position after each push impacts the timing system and dropping the pusher below the bins causes additional vibration and settling issues.

Figure 3:
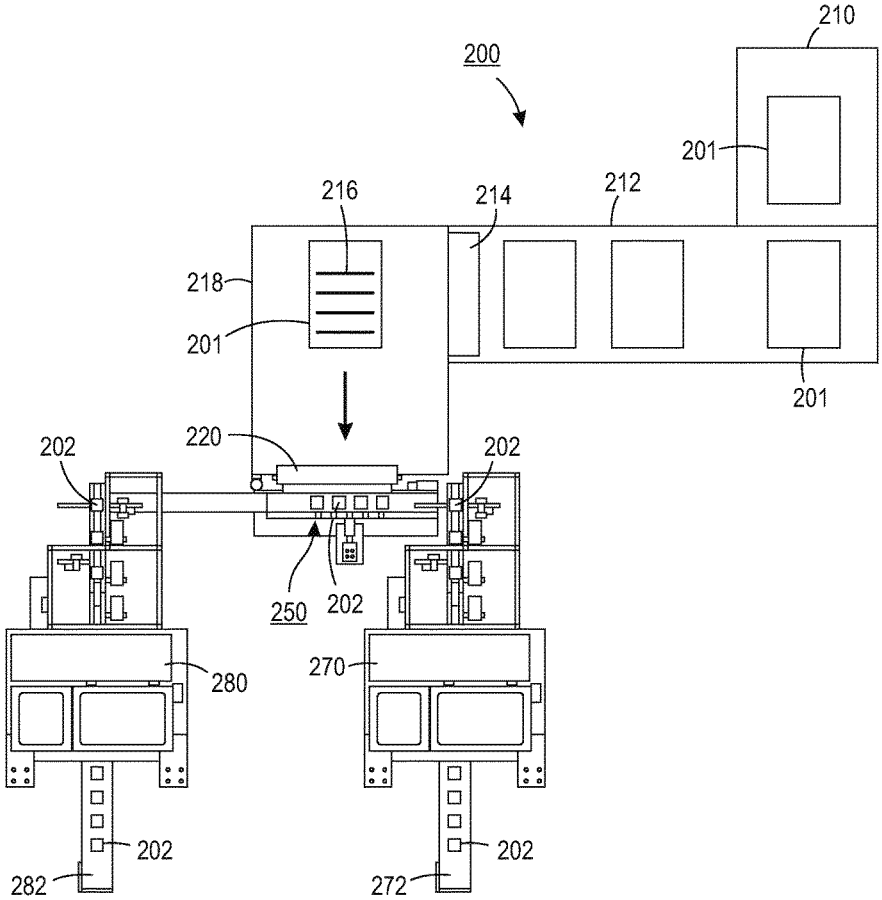
FIG. 3 is a plan view of a collation system with dual push collation and dual banders in parallel.

These issues are addressed in the embodiments described hereinafter in accordance with the present disclosure including in FIG. 3 which shows a collation system 200 in which card sheets 201 are directed into multiple bins and pushed out of the bins into dual banders. Card sheets 201 are outputted from a printer 210 onto a conveyor 212 positioned lengthwise and forwarded into a slitter 214 that is movable between cutting and non-cutting positions. In the cutting position slitter 214 places slits 216 across a portion of card sheets 201 and conveyor 218 conveys the sheets into a second cutter 220 which then cuts the card sheets into individual cards and forwards them into a collection station 250 of FIG. 5 that includes four bins 252, 254, 256 and 258 and will be described in detail hereinafter. The cards are alternately pushed in sets 202 from the bins into a first bander 270 or a second bander 280. Card sets 202 are outputted from bander 270 onto conveyor 272 and bander 280 employs conveyor 282 to present card sets 202 for pickup at both conveyors by an operator. Suitable cutters are disclosed in the above cross-referenced U.S. patent application Ser. No. 15/358,317 to Douglas K. Herrmann filed Nov. 22, 2016 and entitled SEQUENTIAL DIE CUT AND SLITTING FOR IMPROVED COLLATION.

Figure 4:
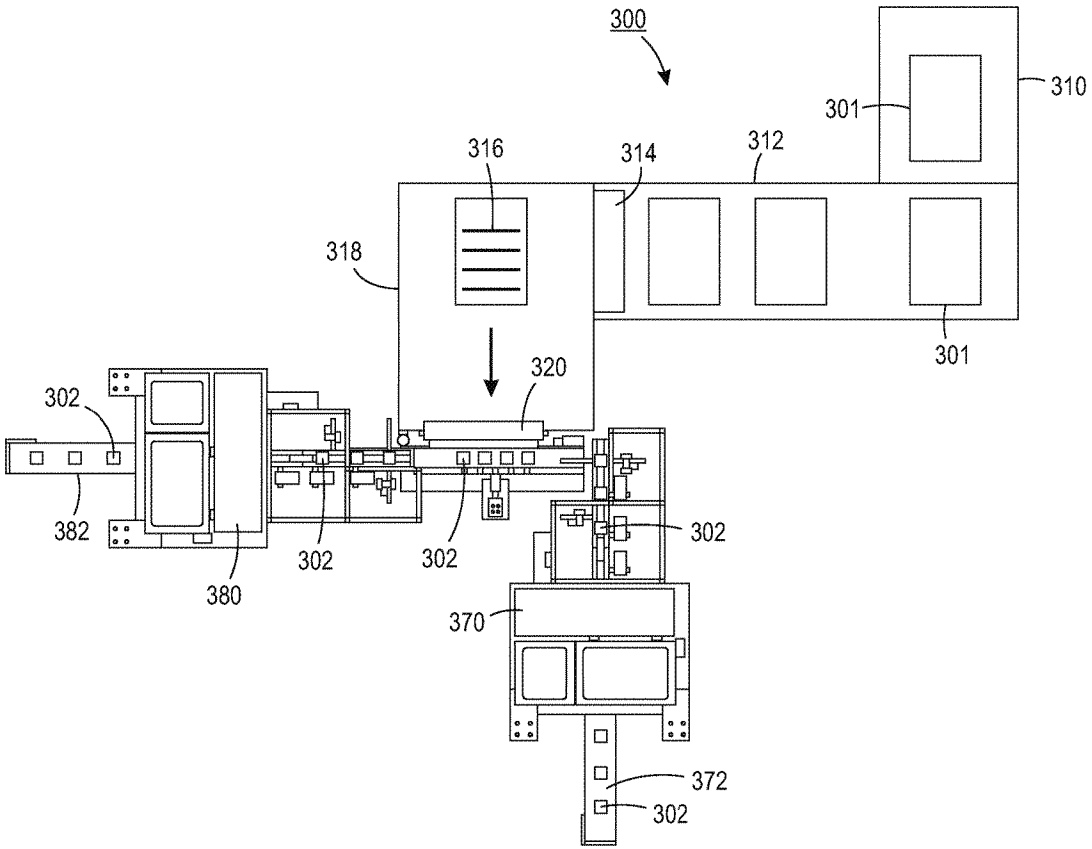
FIG. 4 is a plan view of a collation system with dual push collation and dual banders in a 90° configuration

An alternative embodiment of the present disclosure is shown in FIG. 4 that includes a collation system 300 with dual push collation and dual banders in a 90° configuration to accommodate a different space requirement. Here, card sheets 301 are directed into multiple bins and pushed out of the bins into dual banders. Card sheets 301 are outputted from a printer 310 onto a conveyor 312 positioned lengthwise and forwarded into a slitter 314 that is movable between cutting and non-cutting positions. In the cutting position slitter 314 places slits 316 into a portion of card sheets 301 widthwise and conveyor 318 conveys the sheet into a second cutter 320 which then cuts the card sheets into individual cards and forwards them into bins of a collection station 250 shown in FIG. 5. The cards are alternately pushed in sets 302 from the bins into a first bander 370 or a second bander 380. Card sets 302 are outputted from bander 370 onto conveyor 372 and bander 380 employs conveyor 382 to present card sets 302 for pickup at both conveyors by an operator.

Figure 5:
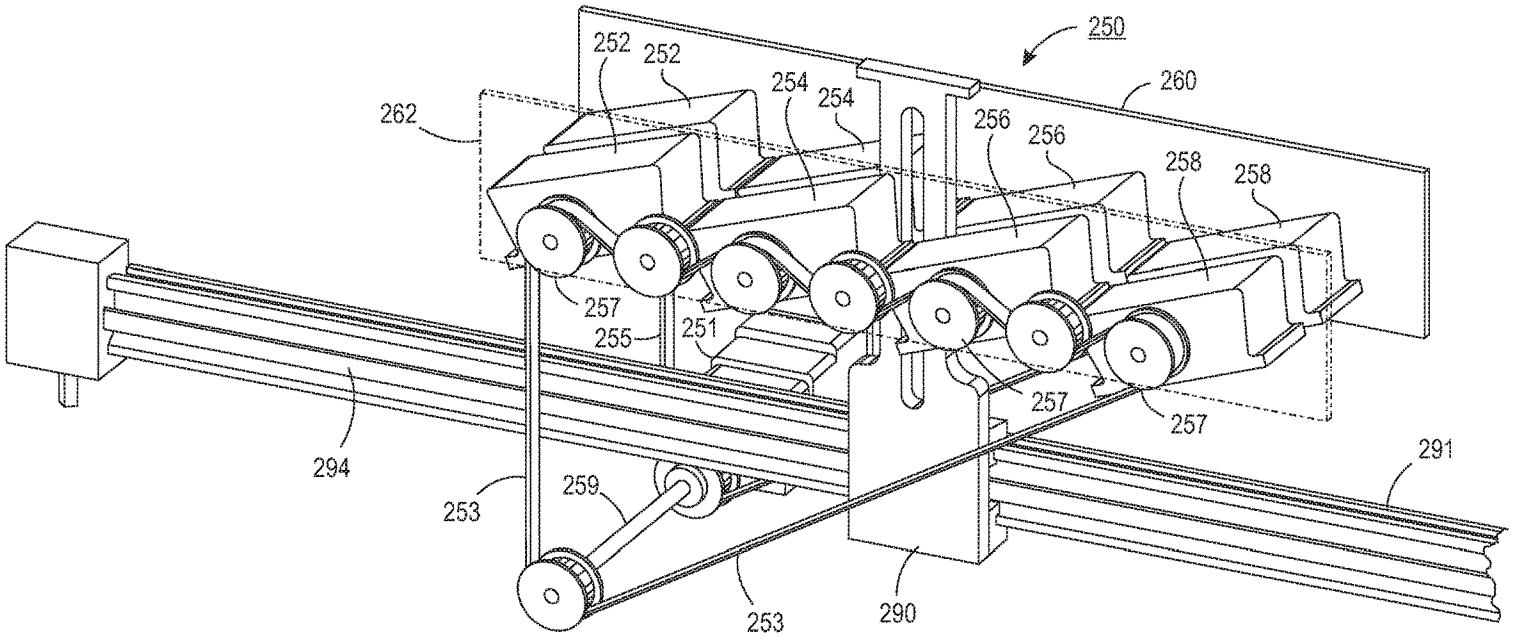
FIG. 5 is a perspective view of dual direction dynamic collection bins shown in a right hand collation configuration in accordance with the present disclosure.
Figure 6:
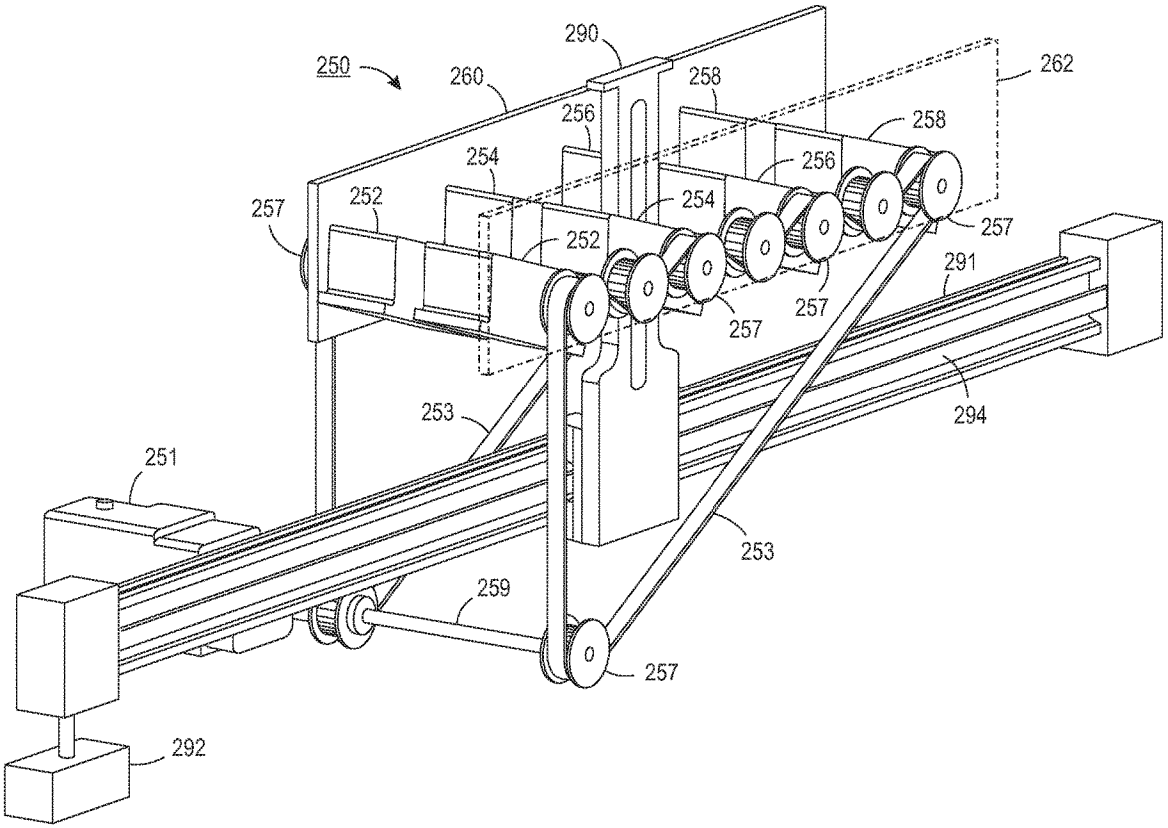
FIG. 6 is a perspective view of the dual direction dynamic collection bins shown in FIG. 5 in a left hand collation configuration.

In FIG. 5, a collection station 250 in accordance with the present disclosure includes dual direction dynamic collection bins 252, 254, 256 and 258 positioned in a right hand configuration. Individual and separate cards exiting slitter 220 enter each bin simultaneously over front wall 260 and then bounce off back wall 262 and drop into the separate bins. Bins 252, 254, 256 and 258 are each separated into two parts with a passageway positioned between the two separate parts. The passageway accommodates a bidirectional pusher 290 that is actuated after a counting of cards for each collation is completed. Bidirectional pusher 290 is mounted on a carriage 291 and is moved in forward and reverse directions by its connection to band 294 which in turn is movably connected to reversible motor 292 shown in FIG. 6. Bins 252, 254, 256 and 258 are mounted for rotation between a right hand position as shown in FIG. 5 and a left hand position as shown in FIG. 6. Rotation of the bins is accomplished through their connection to timing pulleys or sprockets 257 that are reversibly rotated by timing belts 253 through actuation of reversible motor 251. In FIG. 6, bidirectional bins 252, 254, 256 and 258 are shown flipped into an opposite and left hand collation configuration. Once a collation of card sets has been completed in collection bins 252, 254, 256 and 258 of FIG. 5, reversible motor 292 is actuated to drive bands 294 and thereby cause pusher 290 connected to bands 294 to move within the passageway between the bins and push the cards out of collection station 250 into bander 270 in FIG. 3. Immediately afterwards, collection bins 252, 254, 256 and 258 are pivoted by reversible motor 251 into the right hand position shown in FIG. 6 to receive additional card sets. When that collation of card sets is completed reversible motor 292 is again actuated and pusher 290 pushes the card sets towards bander 280 in FIG. 3.

In recapitulation, increased production is created in a collation system with the introduction of a second bander so there is a bander of on each side of the collation system. The collation system includes a pusher which is situated for movement in a passageway between two parts of rotatable bins and is actuated to push completed sets of cards from the bins into a first bander. Once the pusher and card sets have cleared the bins, the dynamic bins flip to an opposite angle and the next collation of cards is collected. Once collected, the card sets are then pushed by pusher into a second and opposite bander. The pusher does not require a reset because the pusher ends the first push in position for the start of the next push to the opposite side bander. Thus, the time lost in the return and reset of pusher systems used to move sets of cards from fixed bins to a bander in the past has been eliminated by the introduction of a card collection station that allows card sets in bidirectional bins to be pushed by a bidirectional pusher to two separate banders and thereby increase productivity of the collation system.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for collecting media in a media collation system, comprising:
   - providing a media collation station;
   - providing multiple bidirectional bins for collecting sets of media;
   - providing each of said multiple bidirectional bins in two separate parts with a passageway therebetween;
   - flipping said multiple bidirectional bins into a first position to receive first multiple sets of media and afterwards flipping said multiple bidirectional bins into a second position to receive second multiple sets of media; and
   - moving a bidirectional pusher through said passageway in forward and reverse directions to capture said sets of media in both directions and remove said sets of media out of said collation station.

2. The method of claim 1, including moving said sets of media from said collation station into a first bander in said forward direction and into a second bander in said second direction.

3. The method of claim 1, including providing each of said two separate parts of said multiple bidirectional bins with lip portions on opposite ends thereof.

4. The method of claim 3, including using said lips portions provided on opposite ends of each of said separate parts of said multiple bidirectional bins for media support.

5. The method of claim 3, including providing each of said multiple bidirectional bins with a smooth media support surface and using each of said lip portions positioned on said opposite ends of each of said separate parts of said multiple bidirectional bins as part of said smooth media support surface of each of said multiple bidirectional bins and as a bin flipping stop member for each of said multiple bidirectional bins.

6. The method of claim 5, including registering media against a portion of a support surface of a first bin and against a back portion of a second bin positioned in front of said first bin.

7. The method of claim 1, including providing each of said multiple bidirectional bins with end portions and using ends of said end portions as stop members for media entering said multiple bidirectional bins.

8. A method for collecting media in a dynamic dual bin position collation system, comprising:
   - providing a media collation station that receives media from an upstream source;
   - providing dual positioning bins within said collation station to receive said media;
   - rotating said dual positioning bins in a first direction to receive first sets of media;
   - rotating said dual positioning bins in a second direction to receive second sets of media;
   - providing each of said dual positioning bins with a passageway therethrough;
   - and
   - moving a bidirectional pusher through said passageway in a forward direction to remove said first sets of media and in a reverse direction to remove said second sets of media from said collation station.

9. The method of claim 8, including conveying said first sets of media into a first bander.

10. The method of claim 9, including conveying said second sets of media into a second bander.

11. The method of claim 8, including rotating said dual positioning bins in said second direction immediately after said bidirectional pusher and first sets of media have cleared said dual positioning bins in said first direction to receive said second sets of media.

12. The method of claim 11, including providing said dual positioning bins with media support surfaces that include multiple acute angled portions when positioned to receive media.

13. The method of claim 11, including positioning a top front portion of one bin against a bottom rear lip portion of another bin when receiving said first sets of media.

14. The method of claim 13, including positioning a bottom front lip portion of said one bin against a rear top portion of said another bin when receiving said second sets of media.

15. A system for collating media, comprising:
   - a media collection station having a plurality of bins adapted to receive sets of media in each of said plurality bins, said plurality of bins being configured for rotation between first and second media receiving positions;
   - first and second banders adapted to receive said sets of media from said plurality of bins; and
   - a pusher adapted to push said sets of media from each of said plurality of bins into said first bander when said plurality of bins have been rotated into said first media receiving position and into said second bander when said plurality of bins have been rotated into said second media receiving position.

16. The system for collating media of claim 15, wherein each of said plurality of bins is configured with a passageway therein, and wherein said pusher is adapted to traverse said passageway in forward and reverse directions while removing media sets from each of said plurality of bins.

17. The system for collating media of claim 16, wherein said pusher is adapted to remove said sets of media from said plurality of bins in a first direction toward said first bander and subsequently remove sets of media from said plurality of bins in a second direction toward said second bander without resetting.

18. The system for collating media of claim 15, wherein said pusher slides on a carriage member.

19. The system for collating media of claim 18, wherein said pusher is connected to a movable band member.

20. The system for collating media of claim 19, wherein said band member is driven by a reversible motor.

* * * * *